US008068084B2

(12) United States Patent
Yeo

(10) Patent No.: US 8,068,084 B2
(45) Date of Patent: Nov. 29, 2011

(54) TIMING CONTROLLER, DATA PROCESSING METHOD USING THE SAME AND DISPLAY APPARATUS HAVING THE SAME

(75) Inventor: Jang-Hyun Yeo, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 661 days.

(21) Appl. No.: 12/243,295

(22) Filed: Oct. 1, 2008

(65) Prior Publication Data

US 2009/0174691 A1 Jul. 9, 2009

(30) Foreign Application Priority Data

Jan. 9, 2008 (KR) ..... 10-2008-002642

(51) Int. Cl.
*G09G 3/36* (2006.01)

(52) U.S. Cl. ..... 345/99

(58) Field of Classification Search ..... None
See application file for complete search history.

(56) References Cited

U.S. PATENT DOCUMENTS

| | | | | |
|---|---|---|---|---|
| 6,720,943 | B1 * | 4/2004 | Lee et al. | 345/87 |
| 2006/0279506 | A1 * | 12/2006 | Choi | 345/98 |
| 2007/0229418 | A1 * | 10/2007 | Yun et al. | 345/87 |
| 2008/0252623 | A1 * | 10/2008 | Yi | 345/204 |

* cited by examiner

*Primary Examiner* — Sumati Lefkowitz
*Assistant Examiner* — Ieesha Gillis
(74) *Attorney, Agent, or Firm* — F. Chau & Associates, LLC

(57) ABSTRACT

A timing controller includes a receiver and a clock generator connected to output terminals of the receiver. The clock generator receives an external clock signal through the receiver and periodically modulates a frequency of the external clock signal to generate a modulation clock signal that is used to process a plurality of pixel data. The clock generator controls a delay time of the modulation clock signal based on a modulation rate of the frequency of the modulation clock signal. According to the timing controller, circuit blocks connected to output terminals of the clock generator are operated by the modulation clock signal. Thus, the circuit blocks operated by the delayed modulation clock signal may be prevented from malfunction due to electromagnetic interference.

19 Claims, 8 Drawing Sheets

TIMING CONTROLLER, DATA PROCESSING METHOD USING THE SAME AND DISPLAY APPARATUS HAVING THE SAME

CROSS-REFERENCE TO RELATED APPLICATION

This application relies for priority upon Korean Patent Application No. 2008-02642 filed on Jan. 9, 2008, the contents of which are herein incorporated by reference in its entirety.

BACKGROUND

1. Technical Field

The present disclosure relates to a timing controller that controls a timing of image data, a method of processing data using the timing controller, and a display apparatus having the timing controller.

2. Discussion of Related Art

In general, a timing controller writes image data that is input in synchronization with a clock signal in its internal memory or reads out the image data from its internal memory in synchronization with the clock signal. That is, the timing controller uses an external clock signal as an internal clock signal and controls input and output operations of the memory using the internal clock signal.

In the case that the timing controller operates a display apparatus having a high resolution, however, an operation speed of the memory driven by the external clock signal becomes faster as the frequency of the external clock signal increases. As a result, a momentary power consumption of the memory rises. As the momentary power consumption rises, electromagnetic interference (EMI) increases. Consequently, a malfunction occurs in the memory.

SUMMARY

Exemplary embodiments of the present invention provide a timing controller capable of preventing a malfunction due to electromagnetic interference.

Exemplary embodiments of the present invention also provide a method of processing data using the timing controller.

Exemplary embodiments of the present invention also provide a display apparatus having the timing controller.

In an exemplary embodiment of the present invention, a timing controller includes a receiver and a clock generator connected to output terminals of the receiver.

The receiver receives pixel data, an external clock signal that processes the pixel data during one horizontal scanning period, and an external data enable signal that defines an effective period and a blank period of the pixel data. The clock generator receives the external clock signal through the receiver, periodically modulates a frequency of the external clock signal, and generates the modulated external signal as a modulation clock signal that is used to process the pixel data. The clock generator controls a delay time of the modulation clock signal based on a frequency modulation rate of the modulation clock signal to output the modulation clock signal.

In an exemplary embodiment of the present invention, a method of processing data using the timing controller is provided as follows. When pixel data and an external clock signal are received, a frequency of the external clock signal is modulated to generate a modulation clock signal that processes the pixel data, and a delay time of the modulation clock signal is controlled based on a frequency modulation rate of the modulation clock signal. Then, the pixel data is written into a memory in synchronization with the external clock signal, and the pixel data is read out from the memory in synchronization with the modulation clock signal of which the delay time is controlled.

In an exemplary embodiment of the present invention, a display apparatus includes a timing controller and a panel module.

The timing controller includes a receiver and a clock generator connected to output terminals of the receiver. The receiver receives pixel data, an external clock signal that processes the pixel data during one horizontal scanning period, and an external data enable signal that defines an effective period and a blank period of the pixel data. The clock generator receives the external clock signal through the receiver, periodically modulates a frequency of the external clock signal, and generates the modulated external signal as a modulation clock signal that is used to process the pixel data. The clock generator controls a delay time of the modulation clock signal based on a frequency modulation rate of the modulation clock signal to output the modulation clock signal.

The panel module includes a display panel displaying an image in response to the pixel data and a driver that controls the display panel in response to a plurality of control signals.

According to the above-described exemplary embodiments, the clock generator to which a spread spectrum technology is applied is connected to output terminals of the receiver in order to decrease the electromagnetic interference. Thus, circuit blocks are operated by the modulation clock signal generated from the clock generator, and the timing controller may be prevented from malfunction due to the electromagnetic interference.

BRIEF DESCRIPTION OF THE DRAWINGS

Exemplary embodiments of the present invention will be understood in more detail from the following descriptions taken in conjunction with the accompanying drawings, wherein.

DETAILED DESCRIPTION OF EXEMPLARY EMBODIMENTS

Hereinafter, exemplary embodiments of the present invention will be explained in detail with reference to the accompanying drawings.

A timing controller according to an exemplary embodiment of the present invention includes a receiver that receives various signals including an external clock signal and a clock generator that employs spread spectrum technology in order to decrease Electro-Magnetic Interference (hereinafter referred to as EMI) caused by the clock signal. The clock generator generates a modulation clock signal whose bandwidth is expanded by the spread spectrum technology in response to the external clock signal. In exemplary embodiments of the present invention, because the clock generator is designed to be connected to output terminals of the receiver, all internal circuits of the timing controller that are operated by clock signals are operated by the modulation clock signal. Thus, all internal circuits of the timing controller may be prevented from a malfunction caused by EMI.

Also, in exemplary embodiments of the present invention, a method is provided in order to solve problems caused when a memory arranged in the timing controller uses the modulation clock signal as a read clock signal.

Hereinafter, the spread spectrum technology will be briefly described with reference to FIGS. 1A and 1B, and then the timing controller to which the spread spectrum technology is applied will be described in detail.

Figure 1A:
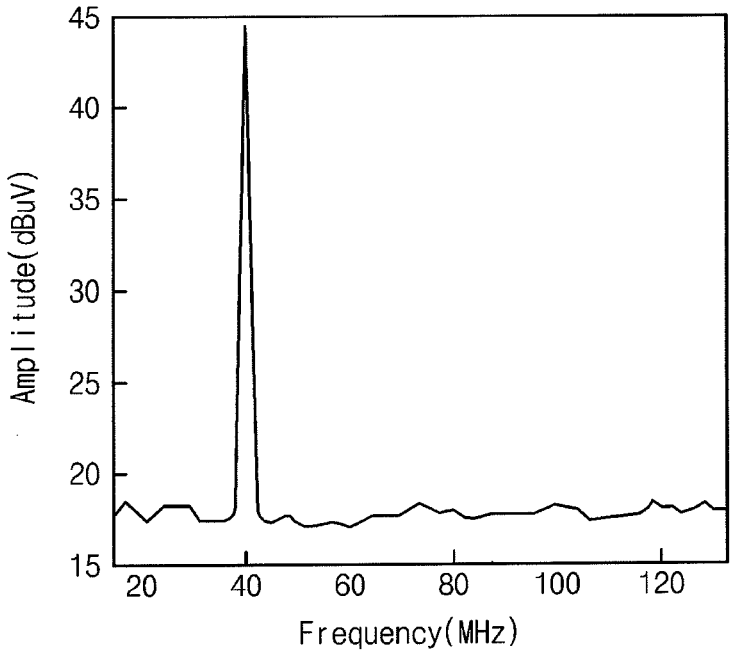
FIGS. 1A and 1B are graphs respectively showing frequency spectrums of an external clock signal before and after modulating the external clock signal when a frequency of the external clock signal is modulated by a spread spectrum technology.
Figure 1B:
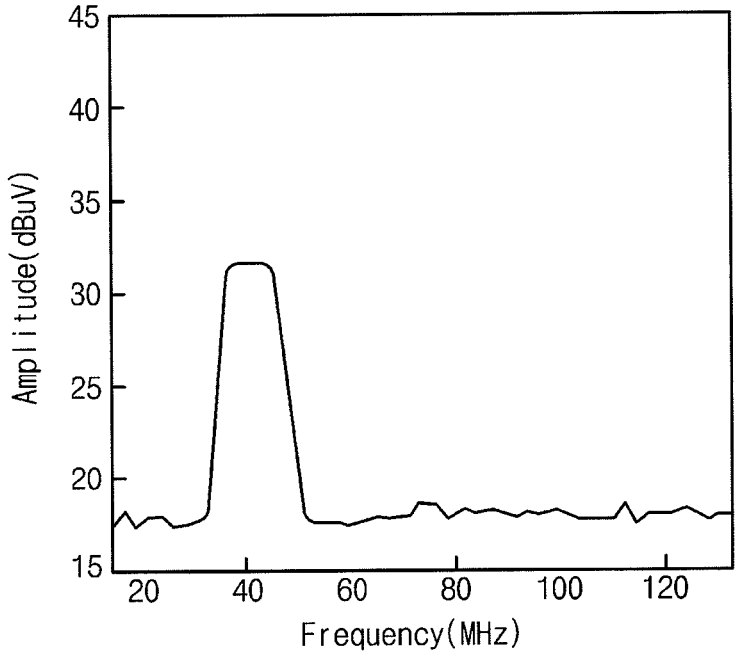

FIGS. 1A and 1B are graphs respectively showing frequency spectrums of an external clock signal before and after modulating the external clock signal when the frequency of the external clock signal is modulated by the spread spectrum technology.

Referring to FIGS. 1A and 1B, a timing controller includes a built-in clock generator to which a spread spectrum technology is applied in order to prevent EMI of an external clock signal input from an exterior.

The spread spectrum technology periodically modulates a frequency of the external clock signal input from the exterior. When the frequency of the external clock signal having a frequency spectrum as shown in FIG. 1A is modulated by the spread spectrum technology, the modulated external clock signal has a broadened frequency band, as shown in FIG. 1B.

During the frequency modulation process, a maximum amplitude of the external clock signal decreases, as shown in FIG. 1B. In general, because the EMI is heavily distributed in a maximum amplitude region of a frequency distribution, a noise level of the EMI distributed in the maximum amplitude region of the frequency is lowered according to the decrease of the maximum amplitude of the signal in that frequency region.

The spread spectrum technology is typically classified into a center spreading method and a down spreading method. The center spreading method modulates a frequency up and down by the same amount with reference to a center frequency. The down spreading method modulates a frequency with reference to a frequency that is lower than the center frequency. In the present exemplary embodiment, the center spreading method is employed for the modulation of the frequency.

Hereinafter, a frequency modulation rate MR and a modulation period MP frequently mentioned in the center spreading method will be briefly described.

Figure 2:
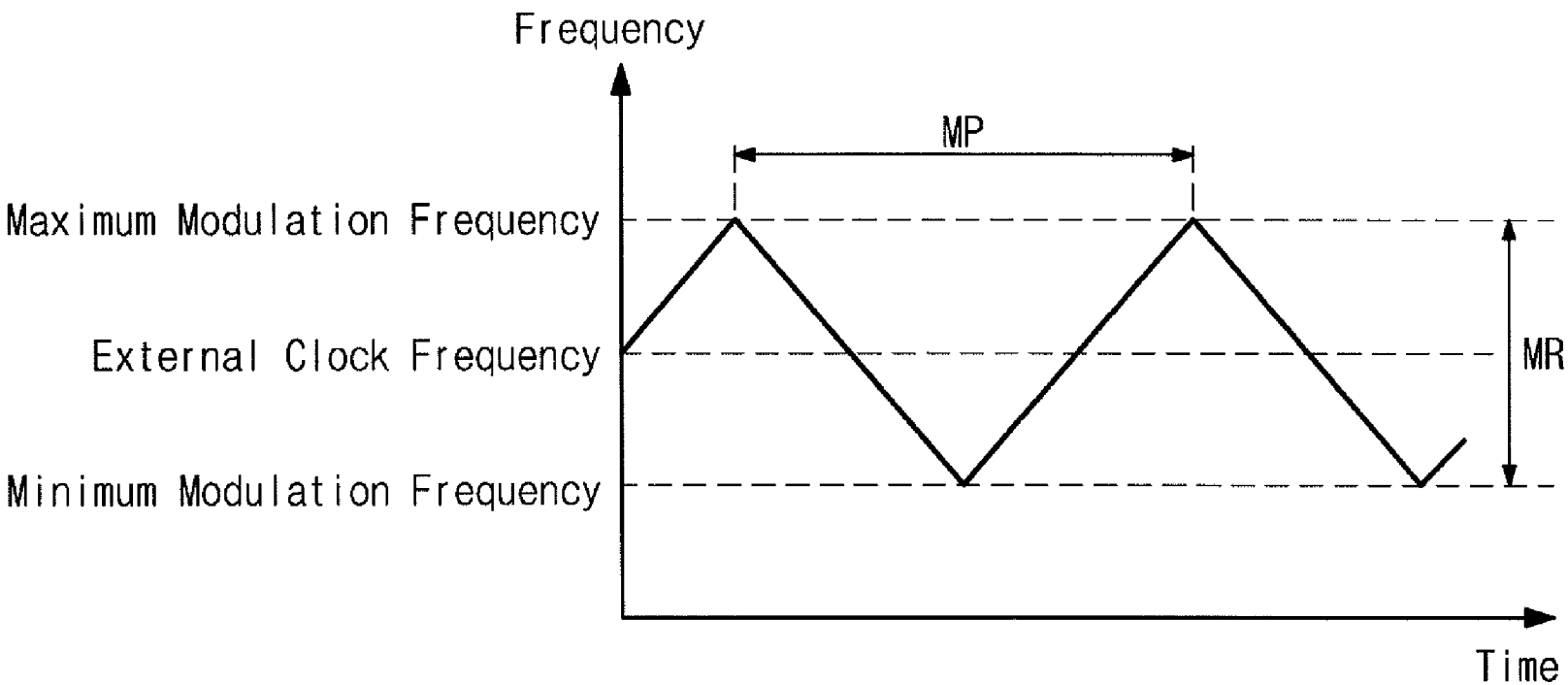
FIG. 2 is a graph showing a frequency modulation having a triangular modulation profile in a center spreading method of a spread spectrum technology.

FIG. 2 is a graph showing a frequency modulation having a triangular modulation profile in a center spreading method of the spread spectrum technology. The modulation profiles in the center spreading methods of the spreading spectrum technology are classified into a triangular modulation profile, a sinusoidal modulation profile, a Hershey-kiss modulation profile, and so forth. In the present exemplary embodiment, the modulation rate MR and the modulation period MP will be described using the triangular modulation profile as a representative example.

Referring to FIG. 2, the modulation rate MR represents a change rate of a maximum modulation frequency with respect to the center frequency of the modulated external clock signal, that is, a frequency of the external clock signal before it is modulated, or a change rate of a minimum modulation frequency with respect to the center frequency of the modulated external clock signal. The modulation rate MR is represented as a percentage. For example, in the case that the center frequency is about 100 Hz, the maximum modulation frequency is about 105 Hz, and the minimum modulation frequency is about 95 Hz, the modulation rate MR is about plus-minus 5%. As a result, the modulation rate MR is a ratio of the frequency of the external clock signal with respect to a difference between the frequency of the modulation clock signal and the frequency of the external clock signal.

The modulation period MP represents a frequency modulation period of the modulated external clock signal. A modulation frequency is defined as the inverse of the modulation period MP. Thus, the maximum modulation frequency is defined as an inverse of the maximum modulation period, and the minimum modulation frequency is defined as an inverse of the minimum modulation period.

Figure 3:
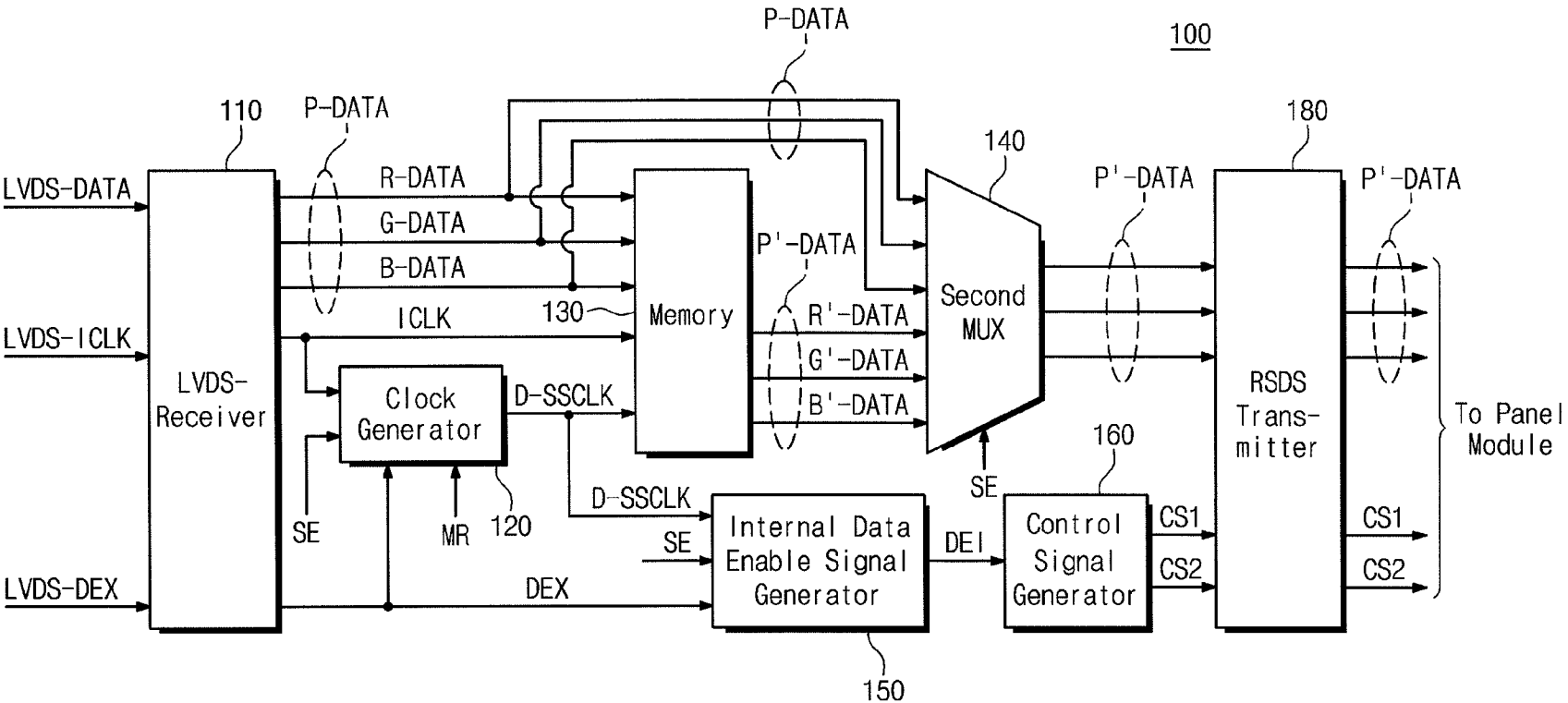
FIG. 3 is a block diagram showing an exemplary embodiment of a timing controller according to the present invention.

FIG. 3 is a block diagram showing an exemplary embodiment of a timing controller according to the present invention.

Referring to FIG. 3, a timing controller 100 includes a low-voltage differential signaling (LVDS) receiver 110, a clock generator 120, a memory 130, and an internal data-enable signal generator 150. Also, the timing controller 100 further includes a second multiplexer (MUX) 140, a control signal generator 160, and a reduced swing differential signaling (RSDS) transmitter 180.

The LVDS receiver 110 receives image data LVDS-DATA, an LVDS-external clock signal LVDS-ICLK, and an external data enable signal LVDS-DEX that are transmitted from an external system (not shown) using an LVDS method. The LVDS receiver 110 changes the image data LVDS-DATA to a data P-DATA having a transistor-to-transistor logic (TTL) level to output the pixel data P-DATA, changes the LVDS-external clock signal LVDS-ICLK to an external clock signal ICLK having the TTL level to output the external clock signal ICLK, and changes the external data enable signal LVDS-DEX to an external data enable signal DEX having the TTL level to output the external data enable signal DEX. The LVDS receiver 110 serves as an interface that changes various signals transmitted at a low-voltage from a LVDS transmitter (not shown) of the external system to signals having the TTL level according to the LDVS method. Therefore, the timing controller 100 is electrically and physically connected to the external system (not shown) through the LVDS receiver 110. The external clock signal ICLK includes a plurality of clock signals corresponding to one horizontal period 1H. For example, when a display panel (not shown in FIG. 3) having a resolution of 1680×1050, that is, a horizontal resolution of 1680 pixels and a vertical resolution of 1050 pixels, is driven by the timing controller 100 shown in FIG. 3, the external clock signal ICLK includes 1680 clock signals during the 1H period. One clock signal is used to process pixel data P-DATA corresponding to one pixel of the pixels that are included in one horizontal line. Thus, when the display panel has the resolution of 1680×1050 pixels, the 1680 clock signals are used to process the pixel data P-DATA corresponding to 1680 pixels during the 1H period.

Figure 4:
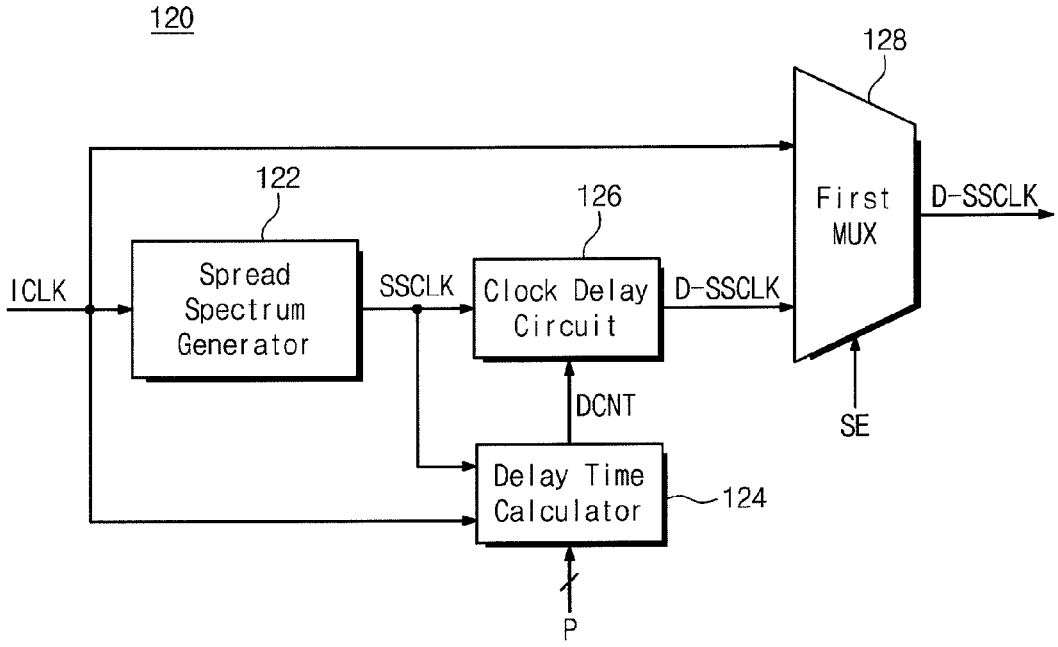
FIG. 4 is a block diagram showing a clock generator of FIG. 3.

The clock generator 120 changes the external clock signal ICLK to a modulation clock signal SSCLK shown in FIG. 4 using the spread spectrum technology to output the modulation clock signal D-SSCLK. Also, the clock generator 120 controls a delay time of the modulation clock signal D-SS- CLK based on the modulation rate MR of the modulation clock signal SSCLK shown in FIG. 4 and outputs the modulation clock signal D-SSCLK. The delay time of the modulation clock signal D-SSCLK is equal to a difference between a start time of the external clock signal ICLK and a start time of the modulation clock signal SSCLK shown in FIG. 4.

Hereinafter, the clock generator 120 will be described in detail with reference to the accompanying drawings.

FIG. 4 is a block diagram showing the clock generator 120 of FIG. 3.

Referring to FIG. 4, the clock generator 120 to which the spread spectrum technology is applied includes a spread spectrum clock generator 122, a delay time calculator 124, a clock delay circuit 126, and a first MUX 128.

The spread spectrum clock generator 122 changes the external clock signal ICLK to the modulation clock signal SSCLK that is periodically modulated within a range from the maximum modulation frequency to the minimum modulation frequency based on a predetermined modulation rate MR input from the external system (not shown).

The delay time calculator 124 receives the external clock signal ICLK, the modulation clock signal SSCLK, and a plurality of parameter values P in order to calculate the delay time of the modulation clock signal SSCLK. The parameter values P include the modulation rate MR, a horizontal resolution, and a blank period value BT of the external data enable signal DEX.

The delay time calculator 124 calculates the delay time of the modulation clock signal SSCLK using the input parameter values P. The calculated delay time includes a minimum delay time and a maximum delay time. The delay time calculator 124 selects a certain delay time within a range from the minimum delay time to the maximum delay time and outputs the selected delay time as a counting signal DCNT. The selected delay time may be varied by a system designer. The counting signal DCNT output from the delay time calculator 124 is applied to the clock delay circuit 126.

The clock delay circuit 126 delays the modulation clock signal SSCLK from the spread spectrum clock generator 122 by the selected delay time based on the counting signal DCNT and outputs the modulation clock signal SSCLK as a delayed modulation clock signal D-SSCLK. The delayed modulation clock signal D-SSCLK is applied to the first MUX 128.

The first MUX 128 receives the delayed modulation clock signal D-SSCLK and the external clock signal ICLK and outputs either the delayed modulation clock signal D-SSCLK or the external clock signal ICLK in response to a selection signal SE. More specifically, the first MUX 128 selects and outputs the delayed modulation clock signal D-SSCLK when the selection signal SE is activated, and the first MUX 128 selects and outputs the external clock signal ICLK when the selection signal SE is inactivated. The delayed modulation clock signal D-SSCLK output from the first MUX 128 is applied to the memory 130 and the internal data-enable signal generator 150 shown in FIG. 3.

As described above, in circuit blocks of the timing controller 100, the clock generator 120 to which the spread spectrum technology is applied is designed to be connected between the LVDS receiver 110 and the remaining circuit blocks arranged in the timing controller 100 after the LVDS receiver 110. The remaining circuit blocks that are driven by a clock are operated by the delayed modulation clock signal D-SSCLK. Thus, the circuit blocks may be prevented from malfunctioning due to EMI caused by the external clock signal ICLK.

Referring again to FIG. 3, the memory 130 receives the pixel data P-DATA and the external clock signal ICLK provided from the LVDS receiver 110. Also, the memory 130 receives the delayed modulation clock signal D-SSCLK from the clock generator 120. The memory 130 stores the pixel data P-DATA using the external clock signal ICLK and outputs the pixel data P-DATA using the delayed modulation clock signal D-SSCLK. That is, the external clock signal ICLK is used as a write clock to write the pixel data P-DATA in the memory 130, and the delayed modulation clock signal D-SSCLK is used as a read clock to read out the pixel data P-DATA from the memory 130.

The delayed modulation clock signal D-SSCLK has a frequency that is periodically modulated within the range from the maximum modulation frequency to the minimum modulation frequency. Accordingly, when the frequency of the delayed modulation clock signal D-SSCLK that is used as the read clock is higher than the frequency of the external clock signal ICLK, a read-out operation may be executed earlier than a write-in operation. Therefore, a minimum delay time is required between the delayed modulation clock signal D-SSCLK and the external clock signal ICLK.

Also, when the frequency of the delayed modulation clock signal D-SSCLK is lower than the frequency of the external clock signal ICLK, the write-in operation for a next pixel data P-DATA may be executed prior to a completion of the read-out operation. Therefore, a maximum delay time is required between the delayed modulation clock signal D-SSCLK and the external clock signal ICLK.

Consequently, the delayed modulation clock signal D-SSCLK is required to have a delay time between the minimum delay time and the maximum delay time. The delay time is calculated by the delay time calculator 124 shown in FIG. 4. The calculation process of the delay time will be described hereinbelow.

The second MUX 140 receives the pixel data P-DATA from the LVDS receiver 110 and the pixel data P'-DATA from the memory 130 and outputs either the pixel data P-DATA or the pixel data P'-DATA in response to the selection signal SE. More specifically, the pixel data P-DATA from the LVDS receiver 110 are selected and output when the selection signal SE is activated, and the pixel data P'-DATA from the memory 130 are selected and output when the selection signal SE is inactivated. The pixel data P'-DATA that are selected by and output from the second MUX 140 are applied to the RSDS transmitter 180.

The internal data-enable signal generator 150 changes the external data enable signal DEX to an internal data enable signal DEI and outputs the internal data enable signal DEI in response to the delayed modulation clock signal D-SSCLK.

The external data enable signal DEX includes an effective period that decides the image data LVDS-DATA applied to pixels connected to one horizontal line in the display panel (refer to FIG. 7) and a blank period in which the image data LVDS-DATA is not displayed.

Figure 5:
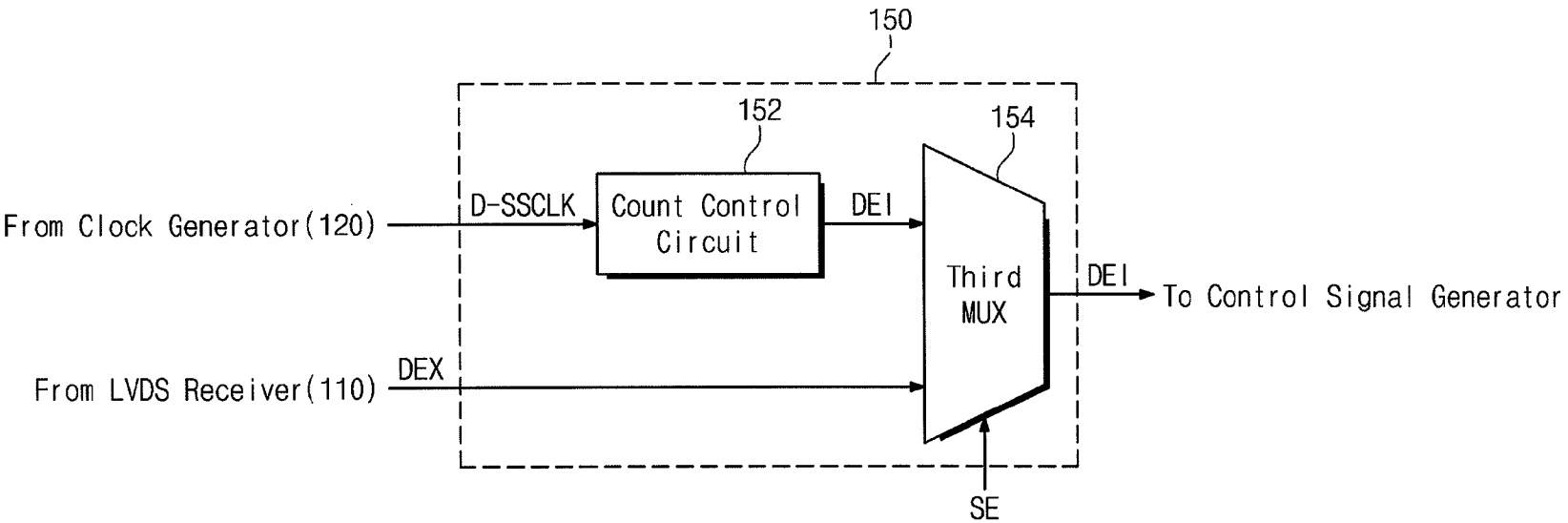
FIG. 5 is a block diagram showing an internal data-enable signal generator of FIG. 3.

FIG. 5 is a block diagram showing the internal data-enable signal generator 150 of FIG. 3.

Referring to FIG. 5, the internal data-enable signal generator 150 includes a count control circuit 152 and a third MUX 154.

The count control circuit 152 counts the number of clocks of the delayed modulation clock signal D-SSCLK received from the clock generator 120. The count control circuit 152 generates the internal data enable signal DEI that includes a high period defining an effective period of the pixel data P'-DATA and a low period defining an ineffective period of the pixel data P'-DATA according to the counted result.

The third MUX 154 selects either the internal data enable signal DEI or the external data enable signal DEX in response to the selection signal SE and outputs the selected signal. In other words, when the selection signal SE is activated, the third MUX 154 selects the internal data enable signal DEI and outputs the internal data enable signal DEI. The internal data enable signal DEI is applied to the control signal generator 160 shown in FIG. 3.

Referring again to FIG. 3, the control signal generator 160 generates a first control signal CS1 and a second control signal CS2 to control an output timing of the pixel data P'-DATA in response to the internal data enable signal DEI and outputs the first and second control signals CS1 and CS2.

The RSDS transmitter 180 receives the pixel data P'-DATA and the first and second control signals CS1 and CS2 and transmits the pixel data P'-DATA and the first and the second control signals CS1 and CS2 to a panel module (not shown) that displays an image.

Hereinafter, a method of calculating the delay time of the modulation clock signal SSCLK will be described.

Figure 6A:
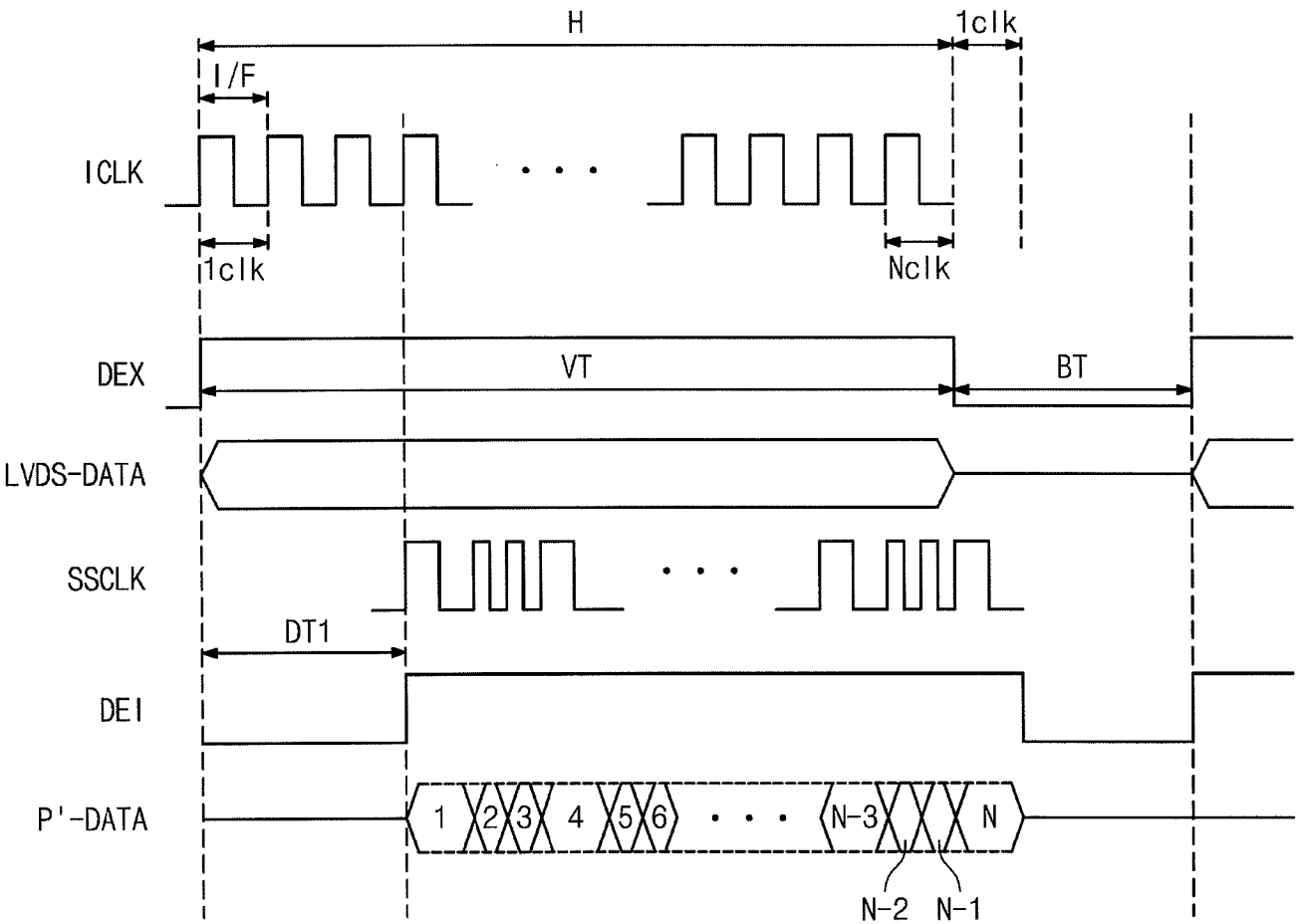
FIGS. 6A and 6B are timing diagrams illustrating a calculating process of a delay time of a modulation clock signal.
Figure 6B:
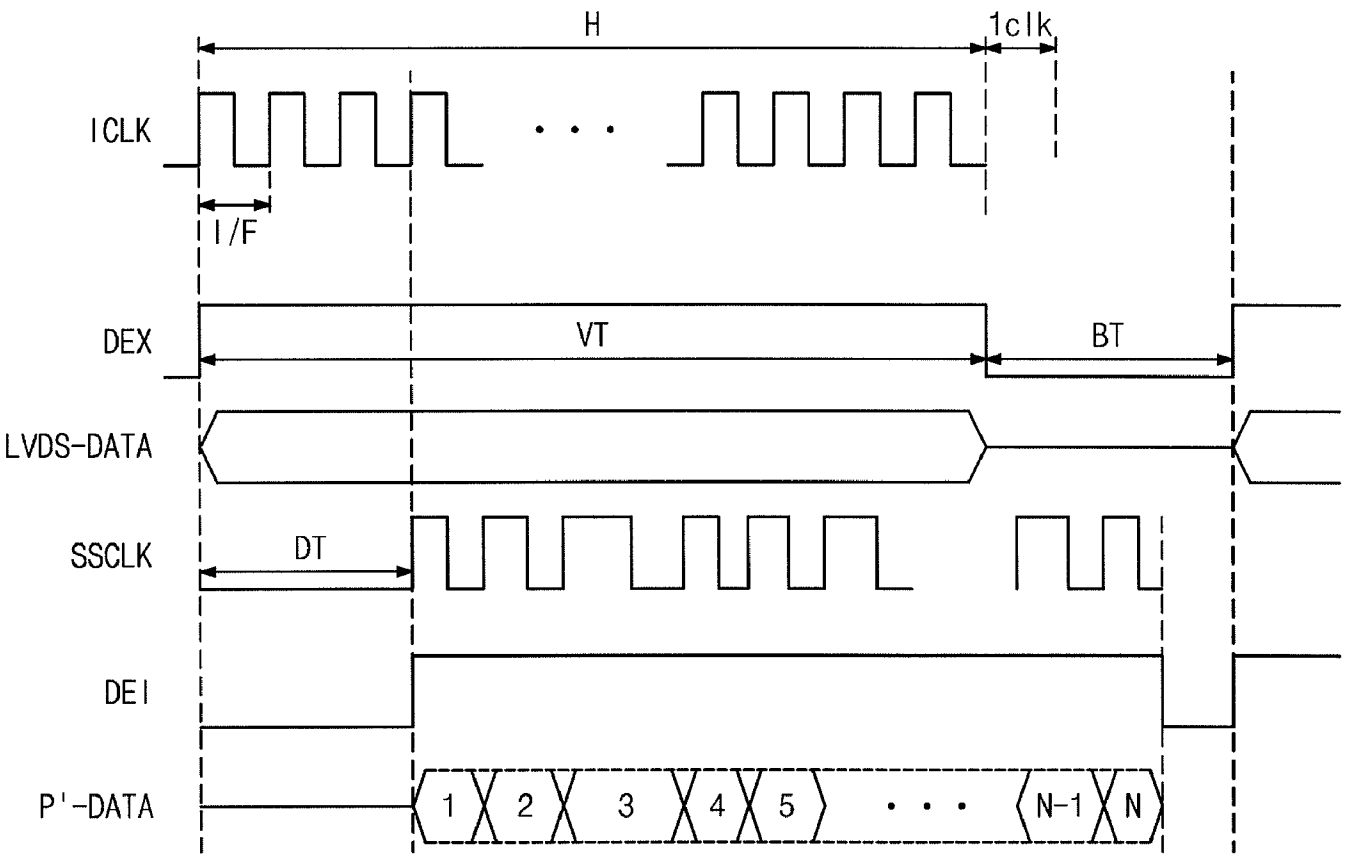

FIG. 6A is a timing diagram illustrating a process of calculating the minimum delay time imparted to the modulation clock signal SSCLK, and FIG. 6B is a timing diagram illustrating a process of calculating the maximum delay time imparted to the modulation clock signal SSCLK. In FIG. 6A, the calculating process is performed under an assumption that the modulation clock signal SSCLK is the maximum modulation frequency. In FIG. 6B, the calculating process is performed under an assumption that the modulation clock signal SSCLK is the minimum modulation frequency.

First, the process of calculating the minimum delay time DT1 of the modulation clock signal SSCLK will be described.

Referring to FIG. 6A, in the case that the frequency of the modulation clock signal SSCLK is the maximum modulation frequency, a time that is a sum of a time corresponding to the total number of clocks H of the external clock signal ICLK and a time corresponding to one clock (1 clk) is smaller than or equal to a time that is a sum of the minimum delay time DT1 and a time corresponding to the total number of clocks H of the modulation clock signal SSCLK. This may be represented by equation 1 as follows.

$$(1/F)\times H+(1/F)\leqq(1/F)\times \mathrm{DT1}+(1/F)\times\{1/(1+\mathrm{MR})\}\times H \qquad \text{Equation 1}$$

In equation 1, F represents the frequency of the external clock signal ICLK, H represents the horizontal resolution, MR represents the modulation rate of the maximum modulation frequency with respect to the center frequency of the modulation clock signal SSCLK or, the frequency of the external clock signal. That is, MR represents a maximum modulation rate.

Referring to equation 1, the time corresponding to the total number of clocks H of the external clock signal ICLK is represented as (1/F)×H, the time corresponding to the one clock 1 clk is represented as 1/F, and the time corresponding to the total number of clocks H of the modulation clock signal SSCLK is represented as (1/F)×H×(1/(1+MR)). The minimum delay time DT1 corresponds to the number of clocks of the external clock signal ICLK corresponding to a difference between a start time of the external clock signal ICLK and a start time of the modulation clock signal SSCLK. Thus, the minimum delay time DT1 may be calculated by multiplying the number of clocks of the corresponding external clock signal ICLK by the time of 1/F.

Equation 2 may be obtained from equation 1 as follows.

$$\mathrm{DT1}\geqq\{\mathrm{MR}/(1+\mathrm{MR})\}\times H+1 \qquad \text{Equation 2}$$

Accordingly, the minimum delay time DT1 of the modulation clock signal SSCLK should be set to have the number of clocks that is equal to or larger than {MR/(1+MR)}×H+1.

Hereinafter, the process of calculating the maximum delay time DT2 of the modulation clock signal SSCLK will be described.

Referring to FIG. 6B, in the case that the frequency of the modulation clock signal SSCLK is the minimum modulation frequency, a time that is a sum of the total number of clocks H of the external clock signal ICLK used to write-in the pixel data P'-DATA and the number of clocks corresponding to the one clock 1 clk and the blank period BT is larger than or equal to a time that is a sum of the maximum delay time DT2 and a time corresponding to the total number of clocks H of the modulation clock signal SSCLK. This may be represented by equation 3 as follows.

$$(1/F)\times H+(1/F)+(1/F)\times BT\geqq(1/F)\times \mathrm{DT2}+(1/F)\times 1/(1+\mathrm{MR})\times H \qquad \text{Equation 3}$$

In equation 3, H represents the horizontal resolution, or the total number of clocks of the external clock signal, and MR represents a modulation rate of the minimum modulation frequency with respect to the center frequency of the modulation clock signal SSCLK, or the frequency of the external clock signal. BT represents the number of clocks of the external clock signal ICLK corresponding to the blank period BT of the external data enable signal DEX.

Equation 4 may be obtained from equation 3 as follows.

$$\mathrm{DT2}\leqq BT+1+\{\mathrm{MR}/(1+\mathrm{MR})\}\times H \qquad \text{Equation 4}$$

Thus, the maximum delay time DT2 of the modulation clock signal SSCLK should be set to have a value that is equal to or less than BT+1+{MR/(1+MR)}×H.

When the MR is about plus-minus 3% in a display panel having a resolution of XGA (1024×768), the minimum delay time DT1 of the modulation clock signal SSCLK is represented as {0.03/(1+0.03)}×1024+1 according to equation 2. That is, the minimum delay time DT1 of the modulation clock signal SSCLK is about 30.82 clk. According to equation 4, the maximum delay time DT2 of the modulation clock signal SSCLK is about BT−30.67 clk. Because the maximum delay time DT2 is larger than the minimum delay time DT1, the following equation comes into existence as 30.82 clk≦BT−30.67 clk. Therefore, BT should be set to have a value that is equal to or larger than 62 clk.

As described above, the parameter P that affects the minimum delay time DT1 and the maximum delay time DT2 of the modulation clock signal SSCLK most is not the frequency F but the modulation rate MR. That is, the minimum delay time and the maximum delay time are proportional to the modulation rate MR.

Hereinafter, a method of processing the pixel data P-DATA using the timing controller 100 shown in FIG. 3 will be described.

When the pixel data P-DATA and the external clock signal ICLK are input from an external device, the modulation clock signal SSCLK is generated using the external clock signal ICLK, and the delay time of the delayed modulation control signal D-SSCLK is controlled based on the modulation rate MR of the generated modulation clock signal SSCLK. The modulation rate MR is the ratio of the frequency of the external clock signal ICLK to the difference between the frequency of the modulation clock signal SSCLK and the frequency of the external clock signal ICLK.

The delay time of the delayed modulation clock signal D-SSCLK is set to have the value within the range from the minimum delay time and the maximum delay time according to equation 1 and equation 2. Then, a random time is selected within the range from the minimum delay time and the maximum delay time, and the modulation clock signal SSCLK is delayed from the start time of the external clock signal ICLK by the selected random time to form the delayed modulation signal D-SSCLK.

The pixel data P-DATA is written in the memory 130 in synchronization with the external clock signal ICLK, and the pixel data P-DATA is read out from the memory 130 in synchronization with the delayed modulation clock signal D-SSCLK of which the delay time is controlled.

Figure 7:
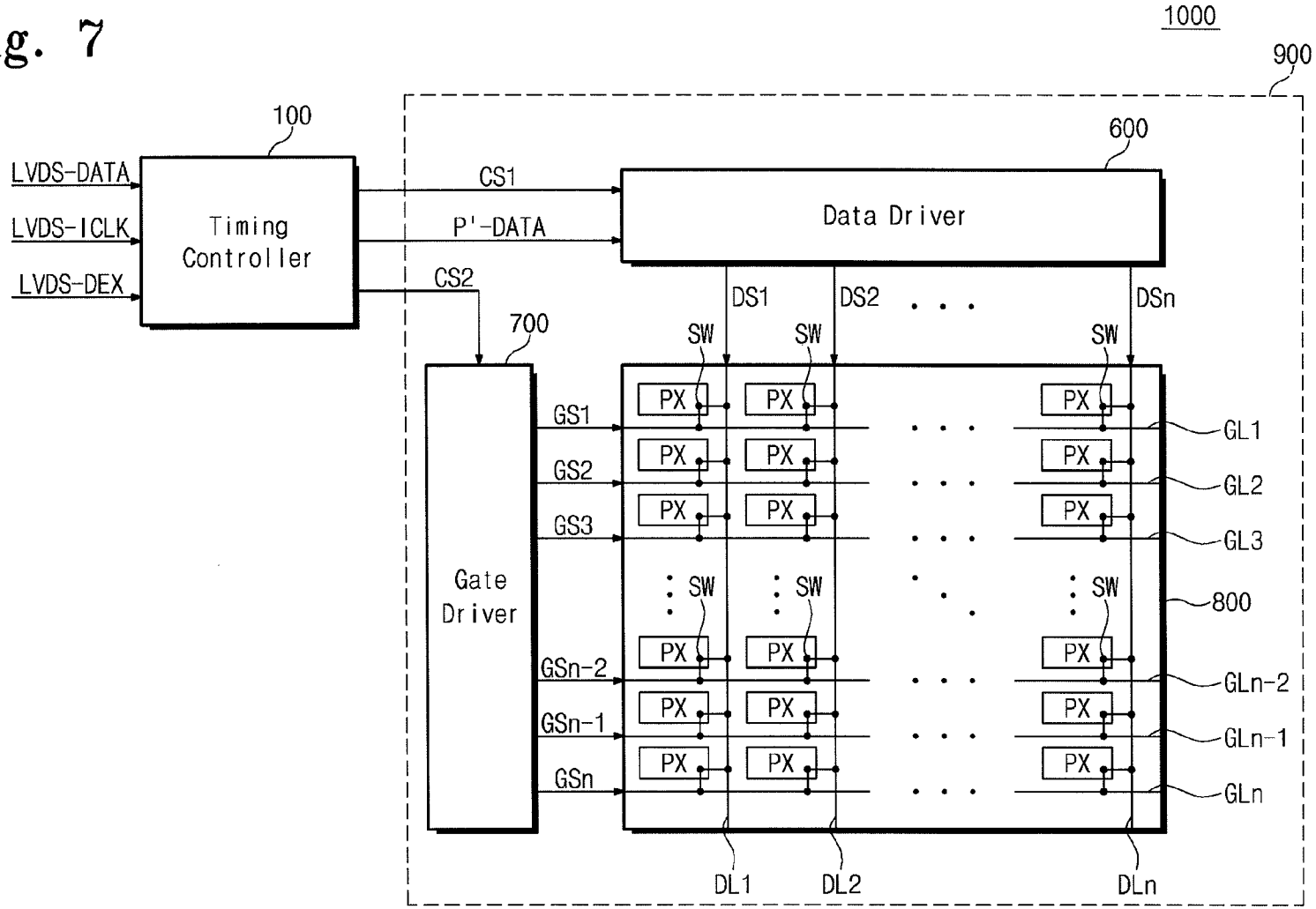
FIG. 7 is a block diagram showing an exemplary embodiment of a display apparatus according to the present invention.

FIG. 7 is a block diagram showing a display apparatus having the timing controller 100 of FIG. 3. In FIG. 7, the same reference numerals denote the same elements as in FIG. 3, and thus the detailed descriptions of the same elements will be omitted.

Referring to FIG. 7, a display apparatus 1000 includes the timing controller 100 and a panel module 900. The timing controller 100 receives the external data enable signal LVDS-DEX, the external clock signal LVDS-ICLK, and the image data LVDS-DATA. The timing controller 100 generates the first control signal CS1, the second control signal CS2, and the pixel data P'-DATA through the signal processing method in which the spread spectrum technology is applied as described in FIGS. 1 to 6B. The first and second control signals CS1 and CS2 and the pixel data P'-DATA output from the timing controller 100 are applied to the panel module 900.

The panel module 900 includes a data driver 600, a gate driver 700, and a liquid crystal display panel 800. The data driver 600 changes the pixel data P'-DATA to a plurality of data signals DS1~DSn in analog form in response to the first control signal CS1 and outputs the data signals DS1~DSn. The data signals DS1~DSn are provided to the liquid crystal display panel 800. The first control signal CS1 includes a horizontal start signal indicating a start of the data signals DS1~DSn, an inversion signal inverting a polarity of the data signals DS1~DSn, and a load signal indicating a start of the data signals DS1~DSn output from the data driver 600.

The gate driver 700 sequentially outputs a plurality of gate signals GS1~GSn in response to the second control signal CS2. The gate signals GS1~GSn are provided to the liquid crystal display panel 800. The second control signal CS2 includes a scan start signal indicating a start of the gate signals GS1~GSn output from the gate driver 700, a scan clock signal used to sequentially output the gate signals GS1~GSn from the gate driver 700, and an output enable signal enabling an output of the gate driver 700.

The display panel 800 includes a plurality of gate lines GL1~GLn, a plurality of data lines DL1~DLn, a plurality of switching elements SW, and a plurality of pixels PX.

The gate lines GL1~GLn are extended substantially in parallel with each other and sequentially receive the gate signal GS1~GSn.

The data lines DL1~DLn are intersected with and insulated from the gate lines GL1~GLn and receive the data signals DS1~DSn.

Each of the switching elements SW is electrically connected to a corresponding gate line of the gate lines GL1~GLn and a corresponding data line of the data lines DL1~DLn.

Each of the pixels PX is electrically connected to a corresponding gate line of the gate lines GL1~GLn and a corresponding data line of the data lines DL1~DLn through a corresponding switching element of the switching elements SW. Thus, each pixel PX receives the data signal and the gate signal. Each pixel PX corresponds to one of a red pixel R to which a data signal corresponding to red data R-DATA is applied, a green pixel G to which a data signal corresponding to green data G-DATA is applied, and a blue pixel B to which a data signal corresponding to blue data B-DATA is applied. The red pixel R, the green pixel G, and the blue pixel B receive a corresponding data signal according to a turn-on operation of the corresponding switching element SW and display a corresponding image in response to the corresponding data signal.

According to the above-described exemplary embodiment, the clock generator to which spread spectrum technology is applied is connected to output terminals of the LVDS receiver in order to decrease EMI. Thus, the circuit blocks are operated by the delayed modulation clock signal generated from the clock generator, thereby preventing a malfunction of the timing controller due to EMI.

Although exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A timing controller comprising:

a receiver receiving pixel data, an external clock signal that processes the pixel data during one horizontal scanning period, and an external data enable signal that defines an effective period and a blank period of the pixel data;

a clock generator receiving the external clock signal through the receiver, modulating a frequency of the external clock signal to generate a modulation clock signal that processes the pixel data, and controlling a delay time of the modulation clock signal based on a frequency modulation rate of the modulation clock signal to output a delayed modulation clock signal; and a memory storing the pixel data in synchronization with the external clock signal and outputting the pixel data in synchronization with the delayed modulation clock signal, and wherein the frequency modulation rate is a ratio of a difference between the frequency of the modulation clock signal and the external clock signal with respect to the frequency of the modulation clock signal.

2. The timing controller of claim 1, wherein the clock generator is connected to output terminals of the receiver.

3. The timing controller of claim 2, wherein the receiver is a low voltage differential signaling interface.

4. The timing controller of claim 1, wherein the clock generator comprises:

a spread-spectrum clock generator periodically modulating the frequency of the external clock signal and outputting the frequency-modulated external clock signal as the modulation clock signal;

a delay time calculator receiving the modulation clock signal and the frequency modulation rate, calculating a delay time of the modulation clock signal based on the frequency modulation rate, and outputting the calculated delay time as a counting signal; and a clock delay circuit delaying the modulation clock signal by the calculated delay time in response to the counting signal to output the delayed modulation clock signal.

5. The timing controller of claim 4, wherein the calculated delay time comprises a minimum delay time that is calculated from a maximum modulation frequency of the modulation clock signal and a maximum delay time that is calculated from a minimum modulation frequency of the modulation clock signal, and the clock delay circuit selects a random time within a range from the minimum delay time to the maximum delay time and delays the modulation clock signal by the calculated delay time in response to the counting signal corresponding to the selected time to output the modulation clock signal.

6. The timing controller of claim 5, wherein the minimum delay time is represented by:

$$DT1 \geqq \{MR/(1+MR)\} \times H+1$$

wherein DT1 represents the minimum delay time, MR represents the frequency modulation rate, and H represents a horizontal resolution.

7. The timing controller of claim 6, wherein the maximum delay time is represented by:

$$DT2 \leqq BT+1+\{MR/(1+MR)\} \times H$$

wherein DT2 represents the maximum delay time, MR represents the frequency modulation rate, and BT represents the number of clocks of the external clock signal corresponding to the blank period of the external data enable signal.

8. The timing controller of claim 1, further comprising:

an internal data-enable signal generator changing the external data enable signal to an internal data enable signal in response to the modulation clock signal to output the internal data enable signal; and a control signal generator generating a plurality of control signals to control an output timing of the pixel data in response to the internal data enable signal.

9. A display apparatus comprising:

a timing controller receiving pixel data and outputting the pixel data;

a panel module including a display panel displaying an image in response to the pixel data and a driver controlling a drive of the display panel, and wherein the timing controller comprises:

a receiver receiving the pixel data, an external clock signal that processes the pixel data during one horizontal scanning period, and an external data enable signal that defines an effective period and a blank period of the pixel data;

a clock generator receiving the external clock signal through the receiver, modulating a frequency of the external clock signal to generate a modulation clock signal that processes the pixel data, and controlling a delay time of the modulation clock signal based on a frequency modulation rate of the modulation clock signal to output a delayed modulation clock signal; and a memory storing the pixel data in synchronization with the external clock signal and outputting the pixel data in synchronization with the delayed modulation clock signal, and wherein the frequency modulation rate is a ratio of a difference between the frequency of the modulation clock signal and the external clock signal with respect to the frequency of the modulation clock signal.

10. The display apparatus of claim 9, wherein the clock generator is connected to output terminals of the receiver.

11. The display apparatus of claim 9, wherein the clock generator comprises:

a spread-spectrum clock generator periodically modulating the frequency of the external clock signal and outputting the frequency modulated external clock signal as the modulation clock signal;

a delay time calculator receiving the modulation clock signal and the frequency modulation rate, calculating a delay time of the modulation clock signal based on the frequency modulation rate, and outputting the calculated delay time as a counting signal; and a clock delay circuit delaying the modulation clock signal by the calculated delay time in response to the counting signal to output the delayed modulation clock signal.

12. The display apparatus of claim 9, wherein the display panel comprises:

a plurality of gate lines;

a plurality of data lines crossing the gate lines;

a plurality of switching elements each electrically connected to a corresponding gate line of the gate lines and a corresponding data line of the data lines; and a plurality of pixels each electrically connected to the corresponding gate line of the gate lines and the corresponding data line of the data lines through a corresponding switching element of the switching elements.

13. The display apparatus of claim 12, further comprising:

an internal data-enable signal generator changing the external data enable signal to an internal data enable signal in response to the modulation clock signal to output the internal data enable signal; and a control signal generator generating a plurality of control signals that control an output timing of the pixel data in response to the internal data enable signal.

14. The display apparatus of claim 13, wherein the control signals comprise a first control signal and a second control signal, and wherein the driver comprises:

a data driver changing the pixel data to an analog data signal in response to the first control signal and applying the analog data signal to the data lines; and a gate driver applying a gate signal that controls the switching elements to the gate lines in response to the second control signal to transmit the analog data signal to a corresponding pixel of the pixels.

15. The display apparatus of claim 14, wherein the first control signal comprises a horizontal start signal indicating a start of the pixel data, an inversion signal inverting a polarity of the data signal, and a load signal indicating an output of the data signal to the data lines, and the second control signal comprises a scan start signal indicating an output of the gate signal to the gate lines, a scan clock signal sequentially outputting the gate signal to the gate lines, and an output enable signal enabling an output of the gate driver.

16. A method of processing data in a timing controller, comprising:

receiving pixel data and an external clock signal;

modulating a frequency of the external clock signal to generate a modulation clock signal that processes the pixel data, and controlling a delay time of the modulation clock signal based on a frequency modulation rate of the modulation clock signal;

writing the pixel data into a memory in synchronization with the external clock signal; and reading out the pixel data from the memory in synchronization with the modulation clock signal of which the delay time is controlled, wherein the frequency modulation rate is a ratio of a difference between the frequency of the modulation clock signal and the external clock signal with respect to the frequency of the modulation clock signal.

17. The method of claim 16, wherein the controlling of the delay time of the modulation clock signal comprises:

calculating a minimum delay time of the modulation clock signal;

calculating a maximum delay time of the modulation clock signal; and selecting a random time within a range from the minimum delay time to the maximum delay time and delaying the modulation clock signal by the selected random time.

18. The method of claim 17, wherein the minimum delay time is represented by:

$$DT1 \geqq \{MR/(1+MR)\} \times H + 1$$

wherein DT1 represents the minimum delay time, MR represents the frequency modulation rate, and H represents a horizontal resolution.

19. The method of claim 18, wherein the maximum delay time is represented by:

$$DT2 \leqq BT + 1 + \{MR/(1+MR)\} \times H$$

wherein DT2 represents the maximum delay time, MR represents the frequency modulation rate, and BT represents the number of clocks of the external clock signal corresponding to a blank period of the external data enable signal.

* * * * *